US005341777A

United States Patent [19]

Miura et al.

[11] Patent Number: 5,341,777

[45] Date of Patent: Aug. 30, 1994

[54] VALVE OPERATION CONTROL SYSTEM

[75] Inventors: Yasushi Miura, Toyoake; Kongo Aoki, Toyota, both of Japan

[73] Assignee: Aisin Seiki Kabushiki Kaisha, Kariya, Japan

[21] Appl. No.: 10,884

[22] Filed: Jan. 29, 1993

[30] Foreign Application Priority Data

Jan. 30, 1992 [JP] Japan ..... 4-015470

[51] Int. Cl.[5] ..... F01L 1/34

[52] U.S. Cl. ..... 123/90.17; 123/90.31; 464/2

[58] Field of Search ..... 123/90.15, 90.17, 90.31; 464/1, 2, 160

[56] References Cited

U.S. PATENT DOCUMENTS

| | | | |
|---|---|---|---|
| 5,067,450 | 11/1991 | Kano et al. | 123/90.17 |
| 5,090,365 | 2/1992 | Hotta et al. | 123/90.17 |
| 5,189,999 | 3/1993 | Thoma | 123/90.17 |

FOREIGN PATENT DOCUMENTS

| | | | |
|---|---|---|---|
| 3929623 | 3/1991 | Fed. Rep. of Germany | 123/90.17 |
| 3929624 | 3/1991 | Fed. Rep. of Germany | 123/90.17 |
| 4037089 | 5/1992 | Fed. Rep. of Germany | 123/90.17 |
| 4143153 | 7/1993 | Fed. Rep. of Germany . | |
| 62-3111 | 1/1987 | Japan . | |
| 63-131808 | 6/1988 | Japan . | |
| 91/03628 | 3/1991 | PCT Int'l Appl. | 123/90.17 |

*Primary Examiner*—E. Rollins Cross
*Assistant Examiner*—Weilun Lo
*Attorney, Agent, or Firm*—Oblon, Spivak, McClelland, Maier & Neustadt

[57] ABSTRACT

A valve operation control system for an internal combustion engine having a cam-shaft and a crank-shaft has an adjusting device for adjusting a phase difference between the cam-shaft and the crank-shaft by being supplied with hydraulic pressure, a driving device integrated with the adjusting device and having an oil pump driven by the cam-shaft and a hydraulic pressure line between the oil pump and the adjusting device, and a hydraulic pressure control device disposed in the hydraulic pressure line for regulating the hydraulic pressure to be supplied to the adjusting device.

4 Claims, 2 Drawing Sheets

VALVE OPERATION CONTROL SYSTEM

BACKGROUND OF THE INVENTION

Field of the Invention

The present invention relates to a valve operation control system for an internal combustion engine, and in particular to a valve operation control system having a phase adjusting means which is interposed between a cam-shaft and a crank-shaft in order to adjust the rotating phase of the crank-shaft relative to the cam-shaft.

Discussion of the Background

In a related valve operation control system which is now pending in the United States Patent and Trademark Office under the Ser. No. 07/789,681, a piston is interposed between a timing pulley and a cam-shaft, and is moved by fluid pressure to thereby adjust the phase difference between the timing pulley and the cam-shaft. In order to generate the fluid pressure, a first oil pump and a second oil pump are used. In the light of the fact that most of oil sucked by the first oil pump serves for lubrication of the engine, a necessary amount of fluid for moving the piston has to be supplied from the second pump.

However, due to the fact that both oil pumps are driven by the common crank-shaft, the rotational number of each pump is equal to that of the engine. Thus, when the engine rotates at a high speed, the second pump consumes much energy. In addition, under the high speed rotation of the engine, the sucking amount and the discharging amount are increased at each oil pump, resulting in that cavitation may occur.

SUMMARY OF THE INVENTION

It is, therefore, a primary object of the present invention to provide valve operation control system without the foregoing drawbacks.

In order to attain the foregoing object, a valve operation control system for an internal combustion engine having a cam-shaft and a crank-shaft is comprised of an adjusting device for adjusting a phase difference between the cam-shaft and the crank-shaft by being supplied with hydraulic pressure, a driving device integrated with the adjusting device and having an oil pump driven by the cam-shaft and a hydraulic pressure line between the oil pump and the adjusting device, and a hydraulic pressure control device disposed in the hydraulic pressure line for regulating the hydraulic pressure to be supplied to the adjusting device.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DESCRIPTION OF THE PREFERRED EMBODIMENTS

A preferred embodiment of the present invention will be described hereinunder in detail with reference to the accompanying drawings.

Figure 1:
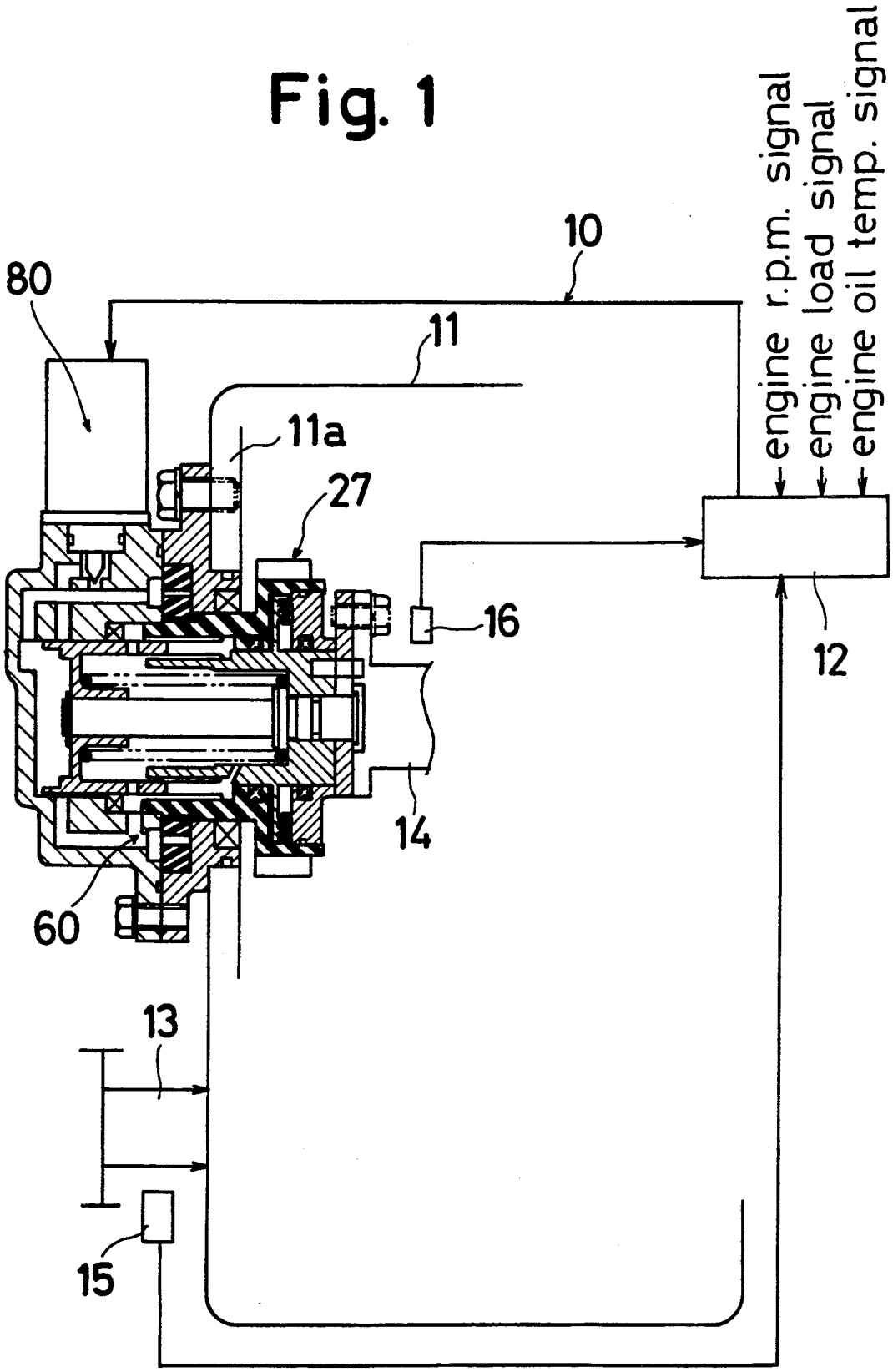
FIG. 1 is a block diagram of an internal combustion engine system which is related to a valve operation control device according to the present invention.

Referring first to FIG. 1, a valve operation control device 10, which is in association with an internal combustion engine 11, is under the control of an electric controller 12 which is in the form of a micro-processor. The engine 10 includes a crank-shaft 13 and a cam-shaft 14 which is driven by the crank-shaft 13 via a transmitting means such as a belt and a gear (neither is shown). Rotations of the cam-shaft 14 and the crank-shaft 13 are set to be detected by a first sensor 16 and a second sensor 15, respectively. The rotational number of the cam-shaft 14 is substantially a half of the rotational number of the crank-shaft 13.

The electric controller is provided with an engine oil temperature signal, an engine load signal, an engine rotational number signal, and other related signals in addition to output signals of the sensors 15 and 16.

Figure 2:
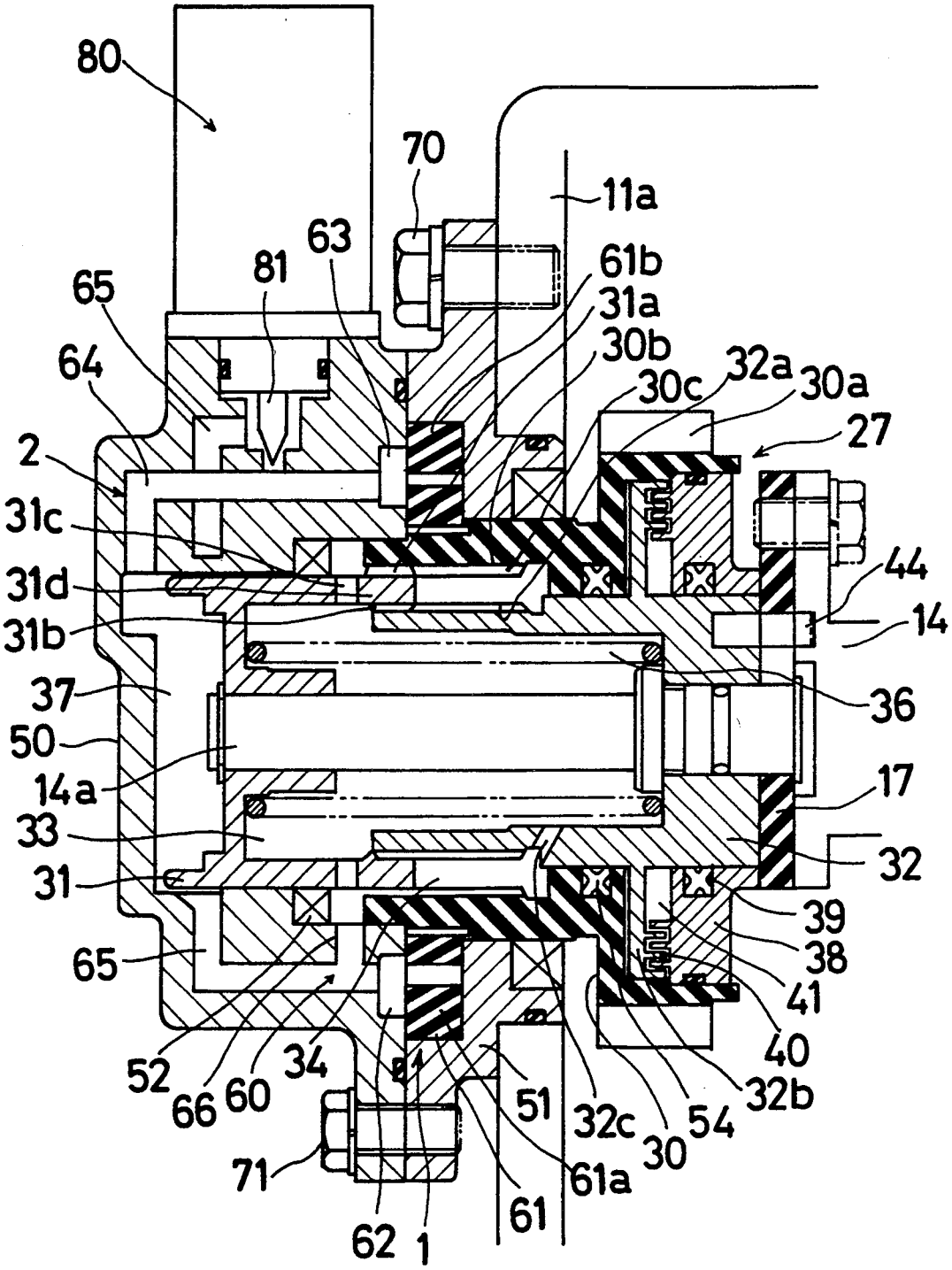
FIG. 2 shows an enlarged cross-sectional view of a valve operation control device in FIG. 1.

As illustrated in FIG. 2, a rear housing 51 is connected at its right side to a cylinder head 11*a* of the engine 11 by a bolt 70. The right side of the rear housing 51 is connected to a front housing 50 by a bolt 71.

A phase adjusting means 27, which is provided at one end portion of the cam-shaft 14, serves for transmitting the rotational torque to the cam-shaft 14 as well as for varying the rotational phase of the cam-shaft 14. An inlet-exhaust valve (not shown) is in association with the cam-shaft 14 and is set to be operated while the cam-shaft 14 is being rotated.

A transmitting member 32 is mounted via a plate 17 to the right end portion of the cam-shaft 14 and is set to be immovable relative thereto by a pin 44. An outer periphery of the transmitting member 32 is mounted with a timing gear 30 which is rotated relative thereto when rotational torque is transmitted to its outermost geared portion 30*a*. A piston 31 is in sliding engagement on the left end portion 14*a* of the cam-shaft 14 as well as an inner surface of the housing 50. A right outermost portion 31*d* of the piston 31 is accommodated between an inner surface of the timing gear 30 and an outer surface of the transmitting member 32 in a sliding manner. The end portion 14*a* of the cam-shaft 14 serves as a guide means for the piston 31. In a space 33 defined at a right side of the piston 31 there is disposed a spring 36 which urges the piston 31 continually in the leftward direction. In addition, a fluid chamber 37 is defined between the front housing 50 and the left side of the piston 31.

The inner surface 30*b* of the timing gear 30 is formed into a helical spline structure 30*c* so as to be in meshing engagement with the right outer surface 31*d* of the piston 31 which is also formed into a helical spline structure 31*a*. In addition, an inner surface of the right outer surface 31*d* of the piston 31 is formed into a helical spline structure 31*b* so as to be in meshing engagement with an outer surface of the transmitting member 32 which is also formed into a helical spline structure 32*a*.

An inner surface of a damper case 38 in which a sealing member 39 is provided is in sliding engagement with the outer surface of the transmitting member 32. The left side of the damper case 38 is in opposition to a flange portion 32*b* of the transmitting member 32 with a clearance, which constitutes a well-known labyrinth groove portion 40. An amount of viscous fluid such as silicon oil is stored in the labyrinth groove portion 40 in order to establish a damper means 41. It is to be noted that a seal ring 54 which is provided at the inner surface of the timing gear 30 and the seal member 39 serve for the prevention of a leakage of the viscous fluid.

A hydraulic driving means 60 which includes a hydraulic pump 1 and a hydraulic pressure line 2 is accommodated within both housings 50 and 51 so as to be integrated with the rotary phase adjusting means 27. The hydraulic pump 1, which is driven by the cam-shaft 14, includes a rotor means 61 which is rotatably held between the timing gear 30 and the rear housing 51, an inlet chamber 62 which is in association with an inlet rotor 61*a* of the rotor means 61, and an outlet chamber 63 which is in association with an outlet rotor 61*b* of the rotor means 61. Thus, the rotor means 61 rotates in accordance with the rotation of the cam-shaft 14, resulting in that the hydraulic fluid is sucked from the inlet chamber 62 and is discharged into the outlet chamber 63.

The hydraulic pressure line 2, which is located within the front housing 50, includes a discharging passage 64 and a bypass passage 65, and permits a fluid communication between the hydraulic pump 1 and the rotary phase adjusting means 27. The discharging passage 64 serves for establishing a fluid communication between the outlet chamber 63 of the hydraulic pump 1 and the fluid chamber 37 of the rotary phase adjusting means 27. In addition, the bypass passage 65 is located between an intermediate portion of the discharging passage 64 and the inlet chamber 62 of the hydraulic pump 1. It is to be noted that a sealing member 52 is provided between the piston 31 and the front housing 50 in order to prevent a pressure decrease in the fluid chamber 37.

A hydraulic pressure control means 80 having a valve 81 is disposed in the bypass passage 65, and is under the control of the electric control means 12 so that the valve 81 can be moved in the vertical direction. That is to say, the amount of hydraulic fluid to be supplied to the fluid chamber 37 is regulated by adjusting the position of the valve 81 which is under the control of the control means 12, with the result that the phase difference between the timing gear 30 of the rotary phase adjusting means 27 and the cam-shaft 14 is controlled. It is to be noted that the hydraulic pressure control means 80 can be positioned in the discharging passage 64.

In order to prevent the pressure in the space 33 from being increased, the piston 31 and the transmitting member 32 are provided with a passage 31*c* and a passage 32*c*, respectively. The passage 31*c* is in fluid communication with the inlet chamber 62 via the port 66 and the bypass passage 65, and the passage 32*c* is in fluid communication with a space 34 defined by the timing gear 31, the piston 31 and the transmitting member 32.

It is to be noted that the hydraulic pump 1 can be connected with another hydraulic pump for circulating an amount of oil in the engine for the cooling thereof.

In operation, when the engine 11 is brought into rotation, the crank-shaft 13 is rotated, the resulting rotational torque is transmitted, via the timing gear 30, the piston 31 and the transmitting member 32, to the cam-shaft 14, thereby establishing the rotation thereof. In accordance with the rotation of the cam-shaft 14, the rotor means 61 sucks the hydraulic fluid from the inlet chamber 62 for discharging the resultant fluid into the rotor outlet chamber 63.

On the basis of the signal from the first sensor 16 which detects the rotary position of the cam-shaft 14 and the signal from the second sensor 15 which detects the rotary position of the crank-shaft 13, the electric control means 12 detects the valve opening-closing timing and sets the rotary phase change quantity of the cam-shaft 14.

When the valve opening-closing timing is desired to be advanced, the electric control means 12 moves the valve 81 of the hydraulic control means 80 in the downward direction, thereby interrupting the fluid communication between the discharging passage 64 and the bypass passage 65, which results in that all fluid in the outlet chamber 63 is supplied, via the discharging passage 64, to the fluid chamber 37. The resulting fluid increases the pressure in the fluid chamber 37, which leads to the rightward movement of the piston 31 against the biasing force of the spring 36, thereby to change the phase difference between the timing gear 30 and the cam-shaft 14. Thus, an advance of the valve opening-closing timing is established.

When the rotary phase change quantity becomes the set one, the electric control means 12 raises the valve 81 by a distance corresponding to the set rotary phase change quantity, and the discharging passage 64 is brought into fluid communication with the bypass passage 65. Thus, some of fluid in the fluid chamber 37 is returned via the discharging passage 64 and the bypass passage 65 to the inlet chamber 62. The continual detection of the valve opening-closing timing by the electric control means 12 enables one to maintain the rotary phase change quantity at the set one by the feedback control.

In addition, though the cam-shaft 14 is subject to change in its rotating phase by moving the piston 31 in the axial direction thereof as a result of the variation in torque from a valve spring (not shown) which is disposed in the intake-discharge valve, the rotating phase of the cam-shaft 14 remains unchanged due to the absorption of the torque variation at the viscous damper means 41.

If the valve opening-closing timing is desired to be delayed, the valve 81 of the hydraulic pressure control means 80 is moved in the upward direction by a distance according to the order from the electric control means 12, which leads to the establishment of the fluid communication between the discharging passage 64 and the bypass passage 65. Thus, most of fluid in the fluid chamber 37 is supplied into the inlet chamber 62 through the discharging passage 64 and the bypass passage 65. At this time, the fluid pressure applied to the fluid chamber 37 will be reduced or decreased with the result that a leftward movement of the piston 31 occurs by the biasing force of the spring 36, which brings a change in phase difference between the timing pulley 30 and the cam-shaft 14. Thus, the valve opening-closing timing is delayed.

When the rotary phase change quantity becomes the set one, the electric control means 12 lowers the valve 81 by a distance corresponding to the set rotary phase change quantity, and the amount of fluid to be supplied to the fluid chamber 37 is increased. The continual detection of the valve opening-closing timing by the electric control means 12 enables the maintaining of the rotary phase change quantity at the set one by feedback control.

In accordance with the present invention, the rotational number of cam-shaft is about a half of that of the crank-shaft, so that the rotational number of the hydraulic pump driven by the cam-shaft becomes about a half of the engine in rotational number. Thus, while the engine rotates at high speed, the power consumed by the hydraulic pump can be reduced. In addition, a connection of the cam shaft driven hydraulic pump to another hydraulic pump which serves for the oil circulation in the engine will reduce the size of the former pump, thereby further reducing consumption of the power or energy for the driving of the former pump.

Moreover, in the present invention, the integration of the rotating phase adjusting means and the hydraulic pump enables an easy mounting thereof on the engine, the prevention of the pressure-decrease in the hydraulic pressure line, and a simple structure in the neighborhood of the hydraulic pressure line.

The invention has thus been shown and described with reference to a specific embodiment, however, it should be noted that the invention is in no way limited to the details of the illustrated structures but changes and modifications may be made without departing from the scope of the appended claims.

What is claimed is:

1. A valve operation control system for an internal combustion engine having a cam-shaft and a crank-shaft, comprising:

a timing gear driven by the crank-shaft;

a transmitting member connected to the cam-shaft; and means for adjusting a phase difference between the cam-shaft and the crank-shaft, the means for adjusting including a pump having an inlet port and an outlet port, a pressure chamber disposed between the inlet port and the outlet port of the pump, a piston associated with the timing gear and the transmitting member in such a manner that movements of the piston in opposite directions respectively establish an increase and a decrease of the phase difference between the cam-shaft and the crank-shaft, one side of the piston being exposed to the pressure chamber, biasing means for biasing the piston toward the pressure chamber, a passage provided between the inlet port and outlet port of the pump and bypassing the pressure chamber, and control means for opening and closing the passage.

2. A valve operation control system in accordance with claim 1, wherein the control means includes an electric controller and an electro-magnetic valve which opens and closes the passages on the basis of a commend from the electric controller.

3. A valve operation control system in accordance with claim 1 further comprising a first sensor for detecting an angular position of the cam-shaft and a second sensor for detecting an angular position of the crank-shaft, wherein the command issued from the electric controller depends on results of the first sensor and the second sensor.

4. A valve operation control system in accordance with claim 1, wherein the biasing means is a spring.

* * * * *